US010677055B2

(12) United States Patent
He et al.

(10) Patent No.: US 10,677,055 B2
(45) Date of Patent: Jun. 9, 2020

(54) FRACTURED ROOF 110 MINING METHOD ENTRY-SIDE ANTI-COLLAPSED STRUCTURE

(71) Applicant: Manchao He, Beijing (CN)

(72) Inventors: Manchao He, Beijing (CN); Zhibiao Guo, Beijing (CN)

(73) Assignee: Manchao HE, Beijing (CN)

( * ) Notice: Subject to any disclaimer, the term of this patent is extended or adjusted under 35 U.S.C. 154(b) by 38 days.

(21) Appl. No.: 15/739,173

(22) PCT Filed: Jun. 24, 2016

(86) PCT No.: PCT/CN2016/086984

§ 371 (c)(1),
(2) Date: Mar. 28, 2018

(87) PCT Pub. No.: WO2016/206617

PCT Pub. Date: Dec. 29, 2016

(65) Prior Publication Data

US 2018/0202291 A1 Jul. 19, 2018

(30) Foreign Application Priority Data

Jun. 24, 2015 (CN) ..... 2015 1 0354518
Sep. 29, 2015 (CN) ..... 2015 1 0634165

(51) Int. Cl.
*E21C 41/18* (2006.01)
*E21D 9/00* (2006.01)
(Continued)

(52) U.S. Cl.
CPC ..... *E21C 41/18* (2013.01); *E21D 9/00* (2013.01); *E21D 11/00* (2013.01); *E21D 15/00* (2013.01); *E21D 20/00* (2013.01); *E21D 21/00* (2013.01)

(58) Field of Classification Search
CPC ..... E21C 41/18
See application file for complete search history.

(56) References Cited

U.S. PATENT DOCUMENTS 3,958,830 A * 5/1976 Johns ..... E21C 25/16 299/31
4,505,517 A * 3/1985 Seddon ..... E21D 23/0091 299/31
5,096,335 A * 3/1992 Anderson ..... E21D 11/152 405/150.1

FOREIGN PATENT DOCUMENTS

CN 101737056 A 6/2010
CN 102337904 A 2/2012
(Continued)

OTHER PUBLICATIONS

International Search Report issued in the Counterpart PCT Application No. PCT/CN2016/086984 dated Sep. 29, 2016, by the SIPO as the ISA.
The 1st office action issued in the counterpart CN application No. 2015106341659 dated Nov. 22, 2016, by the SIPO.

*Primary Examiner* — Janine M Kreck
(74) *Attorney, Agent, or Firm* — Yunling Ren

(57) ABSTRACT

A fractured roof 110 mining method entry-side anti-collapsed structure, one working face of the 110 mining method corresponds to one roadway but without retaining any coal pillar, the roadway retains an entry after the previous working face implements mining top-cutting pressure release, and a roof of the roadway is arch-shape, directional cutting is conducted on one side of the roadway, and the cutting angle is between 15-20 degrees. One working face corresponds to one roadway but without retaining any coal pillar when underground mining is conducted, which can save resources and improve recovery rate of mining. And, the roof of the roadway of the retained entry is arch-shaped, which can improve safety and ensure safety of the coal
(Continued)

mining working face. In addition, a cutting angle is 15-20 degrees, which can effectively determine a roof caving direction after top-cutting and reduce affect to the retained entry.

7 Claims, 2 Drawing Sheets

(51) Int. Cl.

| | |
|---|---|
| ***E21D 20/00*** | (2006.01) |
| ***E21D 11/00*** | (2006.01) |
| ***E21D 15/00*** | (2006.01) |
| ***E21D 21/00*** | (2006.01) |

(56) References Cited

FOREIGN PATENT DOCUMENTS

| | | | | |
|---|---|---|---|---|
| CN | 102536239 | A | | 7/2012 |
| CN | 102966354 | A | | 3/2013 |
| CN | 103195426 | A | | 7/2013 |
| CN | 103233740 | A | | 8/2013 |
| CN | 105134216 | A | | 12/2015 |
| RU | 2178526 | C1 | | 1/2002 |
| RU | 2282720 | C1 | | 8/2006 |
| SU | 514101 | | * | 7/1976 |
| SU | 1348528 | | * | 10/1987 |

* cited by examiner

FRACTURED ROOF 110 MINING METHOD ENTRY-SIDE ANTI-COLLAPSED STRUCTURE

CROSS REFERENCE

The present application is based on International Application No. PCT/CN2016/086984, filed on Jun. 24, 2016, which is based upon and claims priority to Chinese Patent Application No. 201510354518.X, filed on Jun. 24, 2015, and Patent Application No. 201510634165.9, filed on Sep. 29, 2015, and the entire contents thereof are incorporated herein by reference.

TECHNICAL FIELD

This disclosure relates to a non-pillar mining technique, in particular, to an entry-side anti-collapsed structure during a non-pillar mining.

BACKGROUND

At present, in a longwall mining process, a 121 mining method, that is, one working face needs to excavate two roadways firstly and retains one coal pillar for supporting, is employed. In this structure, the coal pillar is required to be retained to cause large waste of resources. And, each working face needs to excavate two roadways to lead to low work efficiency.

In order to save coal resources, non-pillar mining technique is gradually put into practice. However, when the non-pillar mining is used, due to characteristics of a longwall beam roof pressure, periodic pressure will be generated. The periodic pressure not only has great pressure but also creates extremely huge destructing force to the coal mining working face, and even causes coalmine accident.

SUMMARY

A fractured roof 110 mining method entry-side anti-collapsed structure is used in a 110 mining method, one working face of the 110 mining method corresponds to one roadway, but without retaining any coal pillar, the roadway retains an entry after the previous working face implements mining top-cutting pressure release, and a roof of the roadway is arch-shape, directional cutting is conducted on one side of the roadway, and the cutting angle is between 15-20 degrees.

In an optional embodiment, the arch is a semi-circular arch.

In an optional embodiment, the arch is a three-centered arch, which includes three sections of arcs with smooth transition.

In an optional embodiment, the roof of the roadway is supported by means of constant resistance large deformation anchor rods and/or common anchor rods and/or anchor cables.

In an optional embodiment, the roadway is supported by a composite mesh for gangue prevention on its side of releasing pressure.

In an optional embodiment, the roadway is supported by a H-shaped steel prop.

In an optional embodiment, the roadway is supported by a temporary close-standing props in front of the working face.

In an optional embodiment, the H-shaped steel prop and a close-standing single prop in the front of the working face are spaced apart from each other, and are connected with the composite mesh for gangue prevention as a whole.

BRIEF DESCRIPTION OF THE DRAWINGS

The following detailed description of the present disclosure is taken in conjunction with the accompanying drawings.

DETAILED DESCRIPTION

Typical embodiments embodying features and advantages of the present disclosure will be set forth in the following description. It is appreciated that the present disclosure may have various modifications in various embodiments, all without departing from scope of the invention, and the description and drawings are regarded to be illustrative in nature and not limit the present disclosure.

A longwall 110 mining method is a novel coal mining method with one working face only corresponds to one roadway, without retaining any coal pillar.

Figure 1:
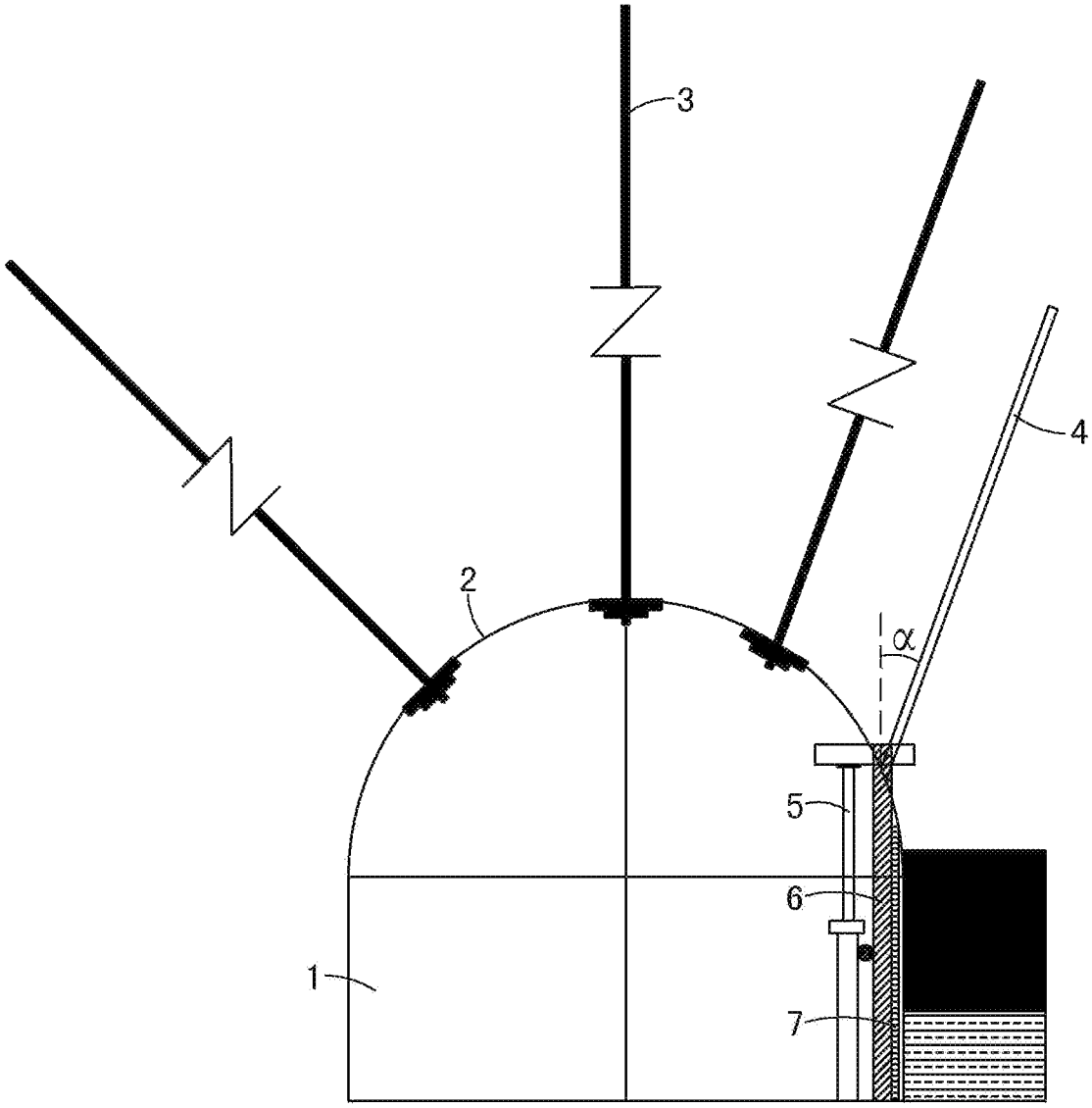
FIG. 1 is a schematic view showing one specific application of a fractured roof 110 mining method entry-side anti-collapsed structure according to the present disclosure.

The fractured roof 110 mining method entry-side anti-collapsed structure of the present disclosure is used in a 110 mining method. As shown in FIG. 1, in the illustrative embodiment, a roadway 1 retains an entry after the previous working face implements mining top-cutting pressure release, and a roof 2 of the roadway 1 is arch-shaped.

In the illustrative embodiment, in order to reinforce supporting, constant resistance large deformation anchor rods 3 are used on the roof 2 to reinforce support strength of the roof 2, typically, 3-7 constant resistance large deformation anchor rods 3 are arranged along a cross section and arranged in an extending direction of the roadway 1 at equal intervals. In addition, common anchor rods and/or anchor cables may be used on the roof 2 in coordination to reinforce the support strength, generally, the anchor rods are smaller, but the anchor cables are longer.

In the illustrative embodiment, one side of the roadway 1 is cut. A cutting line 4 is shown in FIG. 1, and a cutting angle $\alpha$ is greater than or equal to 15 and is less than 20 to ensure that the roof of the mined-out area caved by cutting takes least effects on the roof 2 of the roadway 1.

In the illustrative embodiment, a gangue prevention prop 5, a log 6 and a composite mesh for gangue prevention 7 are used for comprehensive three-dimensional support to prevent scattered broken rocks from falling into the roadway 1. If necessary, the collapsed portion may be protected by grouting. In other embodiments, the roadway is supported by using a H-shaped steel prop, and also by using a temporary close-standing props in front of the working face. In one embodiment, the H-shaped steel prop and the close-standing single prop in the front of the working face are spaced apart from each other, and are connected with a composite mesh for gangue prevention as a whole.

Figure 2:
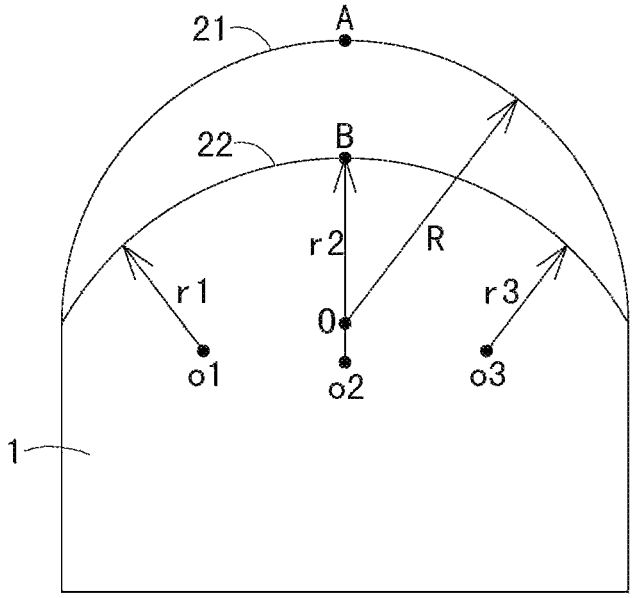
FIG. 2 is a schematic structural view of a roadway roof in the fractured roof 110 mining method entry-side anti-collapsed structure according to the present disclosure.

In the illustrative embodiment, the shape of the roof 2 of the roadway 1 is shown in FIG. 2. Wherein, the roof 21 is a semi-circular arch, having a center point O and a radius R, wherein the center point O is in the middle of the roadway 1, and the radius R is a half of the width of the roadway 1 and has a height point A. The roof 22 is a three-centered arch, which includes three sections of arcs with smooth transition, as shown in the figures, the first section of arcs has a center point O1 and a radius r1, the second section of arcs has a center point O2 and a radius r2, and the third section of arcs has a center point O3 and a radius r3, and the height point of the roof 22 is B. It can be seen from the figures that the height point B of the roof 22 is lower than the height point A of the roof 21, and thereby the roof 22 with the three-centered arch is safer and more reliable. It may be appreciated that FIG. 2 shows an embodiment of the roof 21 being semi-circular arch, and also shows an embodiment of the roof 22 being the three-centered arch, wherein both the roof 21 and the roof 22 are the roof 2 in FIG. 1.

Advantageous effects of the present disclosures are presented as follows: as compared with the prior art, one working face corresponds to one roadway but without retaining any coal pillar when underground mining is conducted, which can save resources and improve recovery rate of mining. And, the roof of the roadway of the retained entry is arch-shaped, which can improve safety and ensure safety of the coal mining working face. In addition, a cutting angle is 15-20 degrees, which can effectively determine a roof caving direction after top-cutting and reduce affect to the retained entry caused by the roof caving to the maximum extent.

The technical solution of the present disclosure has already described through some exemplary embodiments. It is apparent that those skilled in the art can make modifications and variations to the invention without departing from the scope of the invention. The invention is intended to cover the modifications and variations provided that they fall in the scope of protection defined by the following claims or their equivalents.

What is claimed is:

1. A fractured roof entry-side anti-collapsed structure used in 110 mining method, wherein, a roof of a roadway is arch-shape, a directional cutting gap is on one side of the roadway, and the cutting angle of the directional cutting gap is greater than or equal to 15 degree and is less than 20 degree from the vertical direction; and the arch-shape is a three-centered arch, which comprises three sections of arcs with smooth transition.

2. The fractured roof 110 mining method entry-side anti-collapsed structure according to claim 1, wherein, the roof of the roadway is supported by means of anchor rods and/or anchor cables.

3. The fractured roof 110 mining method entry-side anti-collapsed structure according to claim 1, wherein, the roadway is supported by a composite mesh for gangue prevention on a releasing pressure side of the roadway.

4. The fractured roof 110 mining method entry-side anti-collapsed structure according to claim 3, wherein, the roadway is supported by a H-shaped steel prop.

5. The fractured roof 110 mining method entry-side anti-collapsed structure according to claim 4, wherein, the roadway is supported by temporary close-standing props in front of the working face.

6. The fractured roof 110 mining method entry-side anti-collapsed structure according to claim 5, wherein, the H-shaped steel prop and a close-standing single prop in the front of a working face are spaced apart from each other, and are connected with the composite mesh for gangue prevention as a whole.

7. The fractured roof 110 mining method entry-side anti-collapsed structure according to claim 1, wherein, the roadway is supported by a composite mesh for gangue prevention on a releasing pressure side of the roadway.

* * * * *